US005890543A

United States Patent [19]

Job

[11] Patent Number: 5,890,543

[45] Date of Patent: Apr. 6, 1999

[54] SPRINKLER ACTUATOR

[75] Inventor: Norbert Job, Hamburg, Germany

[73] Assignee: Norbulb Sprinkler Elemente GmbH, Germany

[21] Appl. No.: 913,316

[22] PCT Filed: Jan. 23, 1997

[86] PCT No.: PCT/DE97/00120

§ 371 Date: Nov. 10, 1997

§ 102(e) Date: Nov. 10, 1997

[87] PCT Pub. No.: WO97/26945

PCT Pub. Date: Jul. 31, 1997

[30] Foreign Application Priority Data

Jan. 25, 1996 [DE] Germany ..... 196 02 647.4

[51] Int. Cl.[6] ..... A62C 37/08

[52] U.S. Cl. ..... 169/37; 169/38; 169/DIG. 3

[58] Field of Search ..... 169/37–41, 42, 169/DIG. 3, 90

[56] References Cited

U.S. PATENT DOCUMENTS 1,771,826 7/1930 Taylor ..... 169/37

4,938,294 7/1990 Mohler et al. ..... 169/38

FOREIGN PATENT DOCUMENTS 0 301 052 2/1989 European Pat. Off. .

*Primary Examiner*—Andres Kashnikow
*Assistant Examiner*—Lisa Ann Douglas
*Attorney, Agent, or Firm*—Pennie & Edmonds LLP

[57] ABSTRACT

An actuating unit for a sprinkler in automatic fire extinguishing systems; the actuating unit contains an explosive liquid which ensures short triggering times with good overall usability, in which the explosive liquid is or contains a substance derived from a halogen-free or halogenated hydrocarbon in such a way that, in its structural formula: a) I) at least one $CH_2$ group is replaced by oxygen (O), sulphur (S), sulphinyl ($SO_2$) or ii) at least one CH group is replaced by nitrogen, b) there are no hydrogen atoms directly bonded to oxygen, nitrogen or sulphur, and c) iii) there are at least two oxygen atoms with two single bonds, or iii) there are at least two carbonyl groups, or iv) there is at least one oxidized sulphur atom (so or $SO_2$), or v) at least one nitrogen atom is characteristic for amide, imine or nitrile.

9 Claims, 1 Drawing Sheet

Abbildung

D = 3 mm
L = 19, 5 . . . 20, 5 mm
C = ≤ 6 mm
A = 2, 2 mm
B = 2, 0 mm

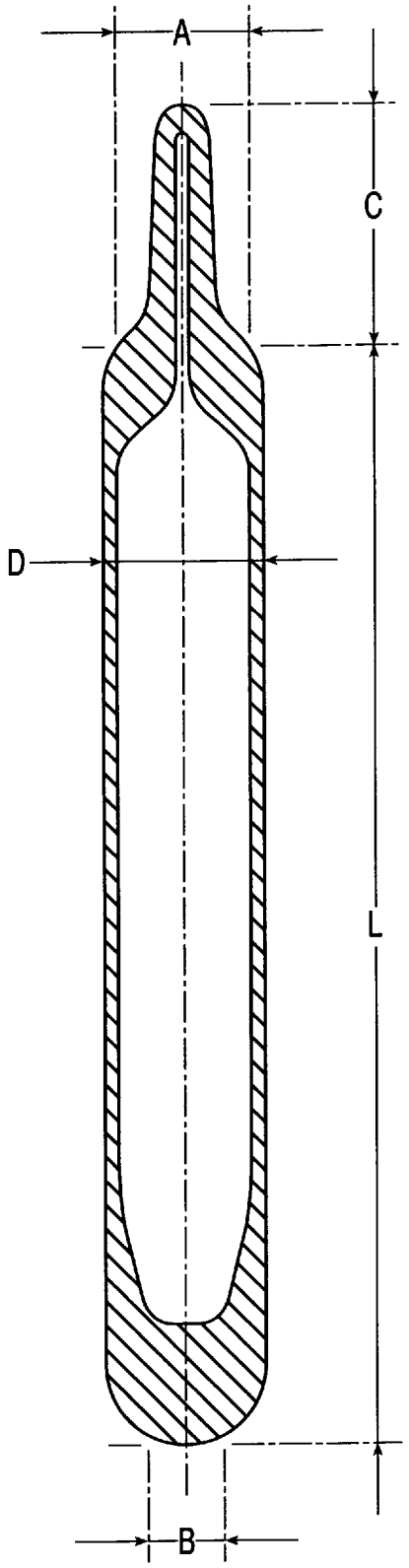
Abbildung
D = 3 mm
L = 19, 5 . . . 20, 5 mm
C = ≤ 6 mm
A = 2, 2 mm
B = 2, 0 mm

SPRINKLER ACTUATOR

The invention relates to an actuating unit for a sprinkler.

Such actuating units are used in automatic fire extinguishing systems where water serves as a fire extinguishing agent and is led through a firmly installed network of pipes and distributed to the seat of a fire via automatically opening spray valves, the sprinkler heads. The type of releasing can be differentiated into solder link, melt crystal and glass bulb sprinkler.

In the latter case, the spray valve is sealed by a glass bulb filled with liquid. When hot conflagration gases reach the sprinkler, the glass bulb is bursted by the explosive liquid and the spray valve is released so that the extinguishing water can be discharged. Depending on conditions and requirements at the place of use, sprinklers with nominal values of the releasing temperature $\partial_A$ from 57° . . . 260° C. and the response time $t_A$ from 10 . . . 50 are used.

$\partial_A$ is the temperature at which the glass bulb heated in a tempering bath bursts. $t_A$ is measured as the duration from immersing the sprinkler in a defined hot air stream (e.g. 135° C. /2.5 m/s at $\partial_A$=68° C.) until the bulb bursts. Tolerances and measurement conditions are laid down by the international approval authorities.

After success in the Eighties in developing fast responding sprinklers, in recent years in the field of fire protection it has been acknowledged that recognition and extinguishing as early as possible is a precondition for effective damage limitation. Since then, the demand, in particular for fast responding glass bulb sprinklers with response times of 14 s and under has sharply increased.

The figure shows typical dimensions of a glass bulb for this intended purpose. Diameter and wall thickness have already been extensively optimised with this construction with regard to the previously available explosive liquids, the stabilities and tolerances required for release temperature and response time.

In order to shorten the response time whilst maintaining the simple and thus low-cost construction, various suggestions have been made. Thus EP B1 0 301 052 lists a series of physical properties of liquids which favour their suitability as explosive liquid:

| | |
|---|---|
| 1. Thermal capacity density | $ç \leqq 1.5$ MJ/m$^3$.K |
| 2. Dynamic viscosity | $\eta \leqq 0{,}8$ mPa.s |
| 3. Thermal conductivity | $\lambda \geqq 0{,}15$ W/m.K 1) |
| 4. Temperature-pressure coefficient | $\beta \geqq 1$ MPa/K |

ç is the product of specific thermal capacity c and the density D.

β is the quotient from thermal expansion factor γ and the compressibility χ.

1) The values of the thermal conductivities in Table III from EP B1 0 301 052 are incorrect. Approximately correct values in W/m·K are obtained by multiplying by the factor 5.8.

Furthermore, EP B1 0 301 052 shows that poorer values for one or several properties could be balanced out to a certain degree by better values for other properties. Thus, for example, excessive ç values which lengthen the response time can be compensated for by higher β values by using thinner glass bulbs with thicker walls which are used to retain the stability. The increased releasing temperature distribution due to the thicker cylinder walls can be balanced out by the more rapid rise in pressure due to the higher temperature-pressure coefficient.

Whether all of the liquid parameters determining the releasing speed are covered by ç, η, λ and β and how the response time can be calculated from this for a given bulb under given circumstances is not currently known.

As besides the further properties mentioned, attention has to be paid to properties such as chemical and thermal endurance, simplicity of finishing, boiling point and melting point, toxicity, environmental compatibility, availability and price, the selection of a suitable liquid can be difficult. In order to fulfil these requirements, the extension from the EP B1 0 301 052 known range of substances therefore is urgently desired.

The object of this invention is to provide such a sprinkler actuator which guarantees a short releasing time with good overall usability.

According to invention, the problem is solved in that the explosive liquid is a substance or contains a substance which is derived from a halogen-free or halogenated hydrocarbon such that in its structural formula a)
- i) at least one $CH_2$ group is replaced by oxygen (O), sulphur (S), sulfinyl (SO) or sulphonyl ($SO_2$), or
- ii) at least one CH group is replaced by nitrogen, b) there are no hydrogen atoms directly bonded to oxygen, nitrogen or sulphur, and c)
- i) there is at least one ring or
- ii) there are at least two oxygen atoms with two single bonds, or
- iii) there are at least two carbonyl groups, or
- iv) there is at least one oxidised sulphur atom (SO or $SO_2$), or
- v) at least one nitrogen atom is characteristic for an amide, imide, imine or nitrile.

The expression "carbonyl group" is understood here as a designation for the functional CO group, as it is present in aldehydes and ketones. The functional group of carbonic acid derivatives is not covered by the expression "carbonyl group" in the sense of this invention.

It could be shown that in the event of the replacement of a $CH_3$ group with an OH group the thermal capacity density ç of an explosive liquid increases so sharply that this can hardly be balanced out any longer by advantages of other properties (Table I). ç is even higher with several OH groups in one molecule (Table II).

If however, the $CH_2$ group in the molecule interior is replaced by oxygen, then the thermal capacity density ç only increases slightly, however it has a highly advantageous effect on the temperature-pressure coefficient β (Table III).

Carbonyl compounds also provide good results, especially when at least two carbonyl groups are present in the molecule.

In particular, it was found that the stiffening of a molecule by means of linking an atom chain to a ring brings advantages both to the thermal capacity density ç and to the temperature-pressure coefficient β.

The coincidence of several of the characteristics recognized above as being favourable to the multiple occurrence of such characteristics also improves the usability of a substance as explosive liquid.

Preferred substances are, for example, cyclic ether and cyclic ester as well as substances which contain several ether and/or ester groups. Suitable substances are also cyclic ketones and those ketones which contain several ketone groups.

Instead of oxygen containing compounds, compounds containing sulphur and nitrogen can be used in a similar manner; these are described in more detail in the main claim.

Selected examples of preferred substances are summarized in Table IV and are compared to tetrachlorethylene which is well-known as an explosive liquid but which is however, detrimental to health and environmentally harmful.

Finally the explosive liquid can also consist of mixtures of the substances described above or contain such mixtures. The following combinations have proved to be especially good:

Dioxan/Trioxane

Dioxolane/Trioxane

Tetrahydrofuran/Dioxolane

In addition to this, the explosive liquid can also contain additional substances, such as solvents for this substances for example. In order that the advantageous properties of the substances are not oppressed, the additional substances should not exceed 80% of the explosive liquid.

TABLE I

Variation of thermal capacity density ç in $MJ/m^3 \cdot K$ when replacing the —$CH_3$ group with the —OH group

| | | | | | |
|---|---|---|---|---|---|
| Butane | $CH_3CH_2CH_2CH_3$ | 1.39 | Propanol | $CH_3CH_2CH_2OH$ | 1.99 |
| Pentane | $CH_3CH_2CH_2CH_2CH_3$ | 1.48 | Butanol | $CH_3CH_2CH_2CH_2OH$ | 1.96 |
| Hexane | $CH_3CH_2CH_2CH_2CH_2CH_3$ | 1.49 | Pentanol | $CH_3CH_2CH_2CH_2CH_2OH$ | 1.94 |
| Heptane | $CH_3CH_2CH_2CH_2CH_2CH_2CH_3$ | 1.53 | Hexanol | $CH_3CH_2CH_2CH_2CH_2CH_2OH$ | 1.91 |
| Octane | $CH_3CH_2CH_2CH_2CH_2CH_2CH_2CH_3$ | 1.56 | Heptanol | $CH_3CH_2CH_2CH_2CH_2CH_2CH_2OH$ | 1.97 |
| Acetaldehyde | $HCOCH_3$ | | Formic acid | HCOOH | 2.63 |
| Acetone | $CH_3COCH_3$ | 1.70 | Acetic acid | $CH_3COOH$ | 2.15 |
| Butanone | $CH_3CH_2COCH_3$ | 1.81 | Propionic acid | $CH_3CH_2COOH$ | 2.13 |
| 2-Pentanone | $CH_3CH_2CH_2COCH_3$ | 1.85 | Butyric acid | $CH_3CH_2CH_2COOH$ | 1.94 |

TABLE II

Thermal capacity density ç of univalent and polyvalent alcohols

| | | |
|---|---|---|
| Methanol | $CH_3OH$ | 2.02 |
| Glykol | $CH_2OHCH_2OH$ | 2.71 |
| Glycerine | $CH_2OHCHOHCH_2OH$ | 2.98 |

TABLE III

Variation of temperature-pressure coefficient β in MPa/K when replacing the $-CH_2-$ group with oxygen $-O-$ and when closing a ring

| | | |
|---|---|---|
| Pentane | $CH_3CH_2CH_2CH_2CH_3$ | 0.67 |
| Cyclopentane | 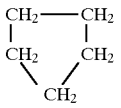 | 1.00 |
| Diethyl ether | $CH_3CH_2OCH_2CH_3$ | 0.90 |
| Tetrahydrofuran | 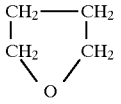 | 1.70 |
| 1.3-Dioxolane | 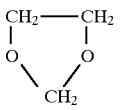 | 2.11 |

TABLE IV

Selected substances/mixtures for fast explosive liquids

| Substance | Boiling Point | Releasing Temperature Distribution | Realeasing Time Mean Value |
|---|---|---|---|
| Tetrachlorethylene | 121° C. | s = 1.35° C. | 11.0 s |
| 1.4-Dioxan | 101° C. | s = 1.15° C. | 11.3 s |
| 1.3-Dioxolane | 75° C. | s = 1.12° C. | 10.9 s |
| Dioxan/Trioxane | 108° C. | s = 1.10° C. | 11.5 s |
| Dioxolane/Trioxane | 95° C. | s = 1.10° C. | 11.0 s |
| Cyclopentanone | 131° C. | s = 1.20° C. | 11.0 s |
| Tetrahydrofuran | 66° C. | s = 1.43° C. | 11.2 s |
| Dioxolane/ Ethylene carbonate | 150° C. | s = 0.94° C. | 11.6 s |
| Tetrahydropyran | 88° C. | s = 1.35° C. | 12.5 s |
| Triacetin | 259° C. | s = 1.12° C. | 12.3 s |

TABLE IV-continued

Selected substances/mixtures for fast explosive liquids

| Substance | Boiling Point | Releasing Temperature Distribution | Realeasing Time Mean Value |
|---|---|---|---|
| Ethylene glykol diacetates | 190° C. | s = 1.06° C. | 12.3 s |
| Dimethyl carbonate | 91° C. | s = 1.23° C. | 11.0 s |
| γ-Butyrolactone | 206° C. | s = 1.00° C. | 11.6 s |
| Propylen carbonate | 242° C. | s = 1.00° C. | 11.9 s |
| Pyridine | 115° C. | s = 1.15° C. | 11.1 S |
| Acetonitrile | 82° C. | s = 1.40° C. | 10.9 s |
| Methylpyrrolidon | 202° C. | s = 1.05° C. | 11.1 s |
| Sulfolane | 285° C. | s = 0.94° C. | 12.0 s |
| Tetrahydrothiophene | 121° C. | s = 1.20° C. | 11.0 s |

I claim:

1. Sprinkler actuator comprising a bulb filled with a explosive liquid which closes the sprinkler outlet nozzle, characterized in that the explosive liquid is a substance or contains a substance which is derived from a halogen-free or halogenated hydrocarbon such that in its structural formula a)

i) at least one $CH_2$ group is replaced by oxygen (O), sulphur (S), sulfinyl (SO) or sulphonyl ($SO_2$), or ii) at least one CH group is replaced by nitrogen, b) there are no hydrogen atoms directly bonded to oxygen, nitrogen or sulphur, and c)

i) there is at least one ring or ii) there are at least two oxygen atoms with two single bonds, or iii) there are at least two carbonyl groups, or iv) there is at least one oxidized sulphur atom (SO or $SO_2$), or v) at least one nitrogen atom is characteristic for an amide, imide, imine or nitrile.

2. Sprinkler actuator according to claim 1, characterized in that the substance is a cyclic ether.

3. Sprinkler actuator according to claim 2, characterized in that the substance is a dioxolane.

4. Sprinkler actuator according to claim 2, characterized in that the substance is a dioxan.

5. Sprinkler actuator according to claim 1, characterized in that the substance is a cyclic ester.

6. Sprinkler actuator according to claim 5, characterized in that the substance is a lactone.

7. Sprinkler actuator according to claim 1, characterized in that the substance is a cyclic ketone.

8. Sprinkler actuator according to claim 7, characterized in that the substance is cyclopentanone.

9. Sprinkler actuator according to any one of claims 1 to 8, characterized in that the explosive liquid contains additional substances whose quantity does not exceed 80% of the explosive liquid.

* * * * *